US005997389A

United States Patent [19]

Dal Pan et al.

[11] Patent Number: 5,997,389

[45] Date of Patent: Dec. 7, 1999

[54] IN-LINE GRINDING DEVICE FOR MILL ROLLS AND/OR PINCH ROLLS

[75] Inventors: Giacinto Dal Pan, Cellatica; Fausto Drigani, Zugliano/Pozzuolo Del Friuli, both of Italy

[73] Assignee: Danieli & C. Officine Meccanich SpA, Buttrio, Italy

[21] Appl. No.: 08/874,339

[22] Filed: Jun. 13, 1997

[30] Foreign Application Priority Data

Jun. 13, 1996 [IT] Italy ..... UD96A0099

[51] Int. Cl.[6] ..... B24B 5/00

[52] U.S. Cl. ..... 451/142; 451/424; 451/425

[58] Field of Search ..... 451/424, 425, 451/142, 49, 24

[56] References Cited

U.S. PATENT DOCUMENTS

| | | | |
|---|---|---|---|
| 3,868,791 | 3/1975 | Burns . | |
| 4,583,273 | 4/1986 | Schnyder et al. . | |
| 4,671,017 | 6/1987 | Ideue et al. | 51/49 |
| 4,716,687 | 1/1988 | Tsukamoto et al. | 51/131.1 |
| 4,811,524 | 3/1989 | Corallo | 51/165 |
| 5,035,086 | 7/1991 | Katsuki et al. | 51/49 |
| 5,618,224 | 4/1997 | Dumas | 451/142 |

FOREIGN PATENT DOCUMENTS

| | | |
|---|---|---|
| 0154319 | 9/1985 | European Pat. Off. . |
| 0672470 | 9/1995 | European Pat. Off. . |
| 456501 | 11/1936 | United Kingdom . |

OTHER PUBLICATIONS

Patent Abtracts of Japn vol. 004, No. 037 (M–004) Mar. 27, 1980 & JP 55 010315 A (Ishikawajima) Jan. 24, 1980—Abstract.

*Primary Examiner*—David A. Scherbel
*Assistant Examiner*—Dung Van Nguyen
*Attorney, Agent, or Firm*—Antonelli, Terry, Stout & Kraus, LLP

[57] ABSTRACT

In-line grinding device for mill rolls and/or pinch rolls, arranged in cooperation with the working surface of the working rolls (11) and/or support rolls (12) and/or intermediate rolls of a rolling stand for sheet, strip and/or wide plate, or in cooperation with pinch rolls placed downstream of the rolling stands and upstream of the winding reels, comprising a plurality of grinding units arranged at intervals on a single support (13) and defined by a grinding tool (17) rotating on a longitudinal axis (14) substantially parallel to the longitudinal axis of the roll (11, 12) to be ground, the grinding tools (17) covering in their entirety a substantial part of the length of the relative roll, each grinding unit (16) having the specific axis of rotation which is movable independently and autonomously with respect to the other grinding units (16) associated with the same stationary support (13), in a substantially radial direction with respect to the longitudinal axis of the roll (11, 12) to be ground.

11 Claims, 2 Drawing Sheets

IN-LINE GRINDING DEVICE FOR MILL ROLLS AND/OR PINCH ROLLS

BACKGROUND OF THE INVENTION

This invention concerns a device to grind mill rolls and/or pinch rolls in-line.

The invention is applied particularly, but not only, in finishing rolling trains used in plants to produce strip, sheet and/or wide plate.

In rolling plants for strip, sheet and/or wide plate, one of the most important problems which operators in the field complain of is the progresive deterioration, during the rolling cycle, of the surfaces of the working rolls and the support rolls and/or intermediate rolls, and also the surface of the pinch rolls.

For it is well-known that the effect of friction, caused by the rolling process, between the material being rolled and the rolls themselves, causes a progressive wear on the surface of the rolls, both in terms of roughness of the working surface and in terms of the longitudinal profile of the surface.

In hot rolling, apart from the mechanical effect caused by this friction, it is necessary to consider and add the effect of the rapid and ample thermal cycles to which the surface of the rolls is subjected with every revolution of the roll.

The unevennesses which are produced on the surface of the working rolls cause a deterioration in the quality of the surface of the product, both in terms of finish and in terms of the transverse profile obtained which is not the one desired.

This deterioration becomes progressively more marked until it becomes necessary to substitute the worn rolls, whose surface is then ground off-line so that the rolls can be used again.

Since the speed at which the surface of the rolls deteriorates increases in proportion to the progress of the deterioration itself, it becomes necessary to substitute the rolls frequently not only to maintain the surface quality of the product at sufficient and acceptable levels but also to extend the working life of the rolls and therefore limit the wear, as the cost of the rolls is a considerable factor in the total cost involved in the working of the product.

These considerations may be extended to the pinch rolls, which are normally present on the rolling lines downstream of the stands and upstream of the winding reels.

The problem of the progressive deterioration also concerns the support rolls which, in the so-called four high rolling stand, are arranged in cooperation with a relative working roll and in contact with it.

The variation in the longitudinal profile of the support roll caused by wear causes a deformation of the axis of the relative mating working roll, and an unwanted modification of the gap between the working rolls, which causes a further worsening of the quality of the product being rolled in terms of the transverse profile.

From what we have said above, it is clear that the rolls, and particularly the working rolls, need to be replaced frequently, which however requires the line to be stopped and therefore a reduction in production with consequent increases in the cost of working the product.

In order to try to solve these problems various solutions have been proposed to overhaul the surface of the rolls and the pinch rolls by means of so-called in-line grinding, using grinding devices arranged in cooperation with the surface of the various rolls.

Grinding devices known to the state of the art are composed of a plurality of idler grinding wheels set obliquely with respect to the axis of the relative roll. These grinding wheels are made to rotate by the contact with the rolls, generally at a limited speed, as in U.S. Pat. No. 4,716,687.

Another solution is to include a series of coaxial grinding wheels brought into rotation by a common or differentiated drive device as in EP-A-0,672,470.

Other solutions known to the state of the art include grinding wheels or grinding tools thrust against the rolls by autonomous pressure means as in EP-A-0.154.319.

However it must be pointed out that the wear on the rolls is not uniform along the circumference, it has localised depressions; this means that the quantity of material to be removed varies, even considerably, during the grinding step along the same generating line of the roll.

Consequently, in-line grinding devices known to the state of the art have the disadvantage that they do not carry out a differentiated grinding action according to the circumferential areas of the roll on which they are working.

A further disadvantage of the grinding devices known to the state of the art is that the grinding wheels, or parts of the grinding wheels, may have a differentiated wear, as a consequence of the greater or lesser quantity of material removed, and this causes a differentiated reduction in the diameter.

As a consequence, the grinding is not uniform on the circumference of the roll and therefore the final result is unsatisfactory.

SUMMARY OF THE INVENTION

The present applicants have designed, tested and embodied the following invention in order to overcome the shortcomings which those operating in the field have complained of for some time, and to achieve further advantages.

The purpose of this invention is to provide an in-line device to grind mill rolls and pinch rolls which is able to remove differentiated quantities of material according to the different conditions of wear which are to be found along each generating line of the relative roll.

This ability to remove differentiated quantities of material makes it possible to maintain the desired profile along the whole body of the roll and, in particular, it guarantees a high level of removal even in those areas of the roll where there is little wear, where it is necessary to remove more of the surface of the roll in order to ensure that a uniform and regular profile is maintained.

Moreover, the differentiated feed of the axis of the grinding wheels, according to the invention, makes the grinding system substantially independent of the variation of the working diameter of the individual grinding wheels in relation to their transverse positioning in areas of greater or lesser removal and therefore of greater or lesser wear of the grinding wheels themselves.

According to the invention, the device comprises a plurality of units of rotating and independent grinding wheels, with the relative rotating grinding tools, keyed onto a stationary beam acting as a common support arranged with its longitudinal axis substantially parallel to the axis of the roll to be ground.

This support beam can be moved both axially and perpendicularly with respect to the axis of the relative roll.

Every grinding unit comprises at least a thrust device, arranged inside the support beam and inside the grinding unit, able to move, individually and autonomously with respect to the other grinding units, the relative grinding tool in a direction substantially radial to the axis of the roll to be ground.

The thrust devices can be composed of prestressed springs, packs of springs, pneumatic cylinders or hydraulic cylinders or other suitable devices, provided that the intensity of their action can be adjusted independently of that of the other grinding units to be found on the common support.

The independent drive of these thrust devices is governed by a control unit, advantageously connected functionally to means to measure the profile of the roll to be ground, and also to means to recognise the position of the grinding tool with respect to the circumference of the roll.

The grinding units adjacent to each other are connected by means of joint systems which allow the rotary movement to be transmitted along the whole length of the support beam; at the same time these joint systems make it possible to release the grinding units from each other and allow them to be moved independently at least in the direction radial to the axis of the roll to be ground.

BRIEF DESCRIPTION OF THE DRAWINGS

The attached figures are given as a non-restrictive example and show a preferred embodiment of the invention, as follows.

DETAILED DESCRIPTION OF THE PREFERRED EMBODIMENTS

Figure 2:
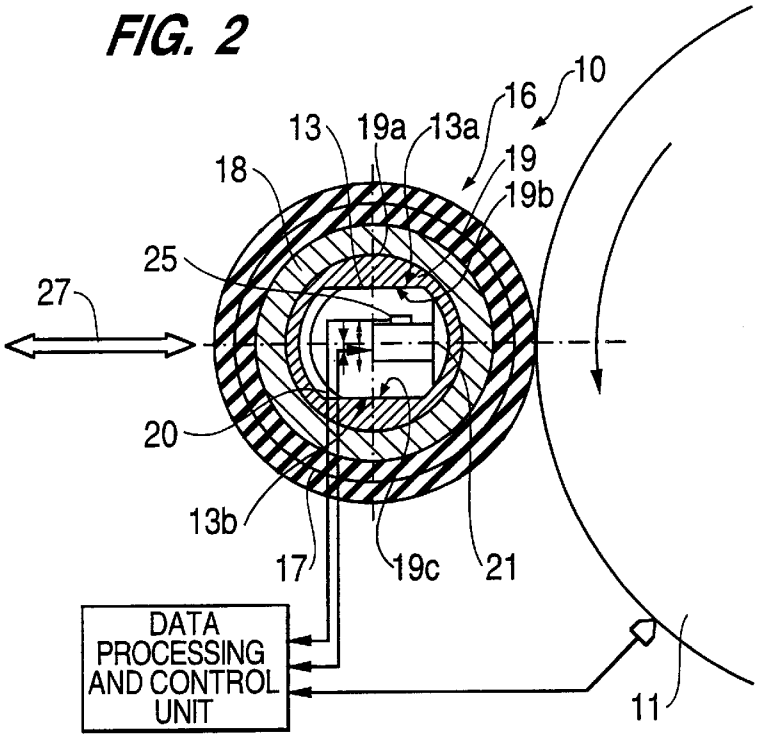
FIG. 2 shows a transverse section of the device according to the invention.
Figure 1:
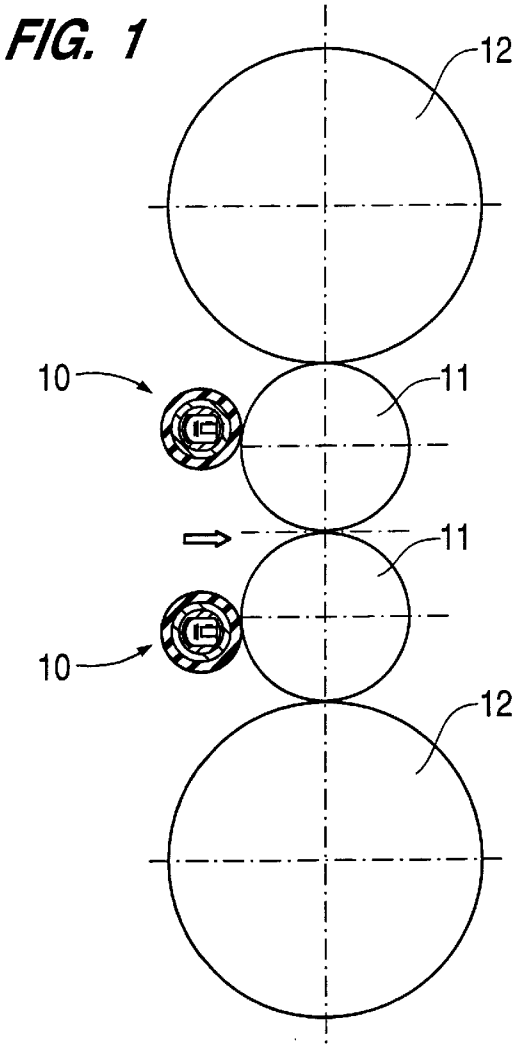
FIG. 1 shows in diagram form the in-line grinding device according to the invention associated with the working rolls of a four high rolling stand.
Figure 3:
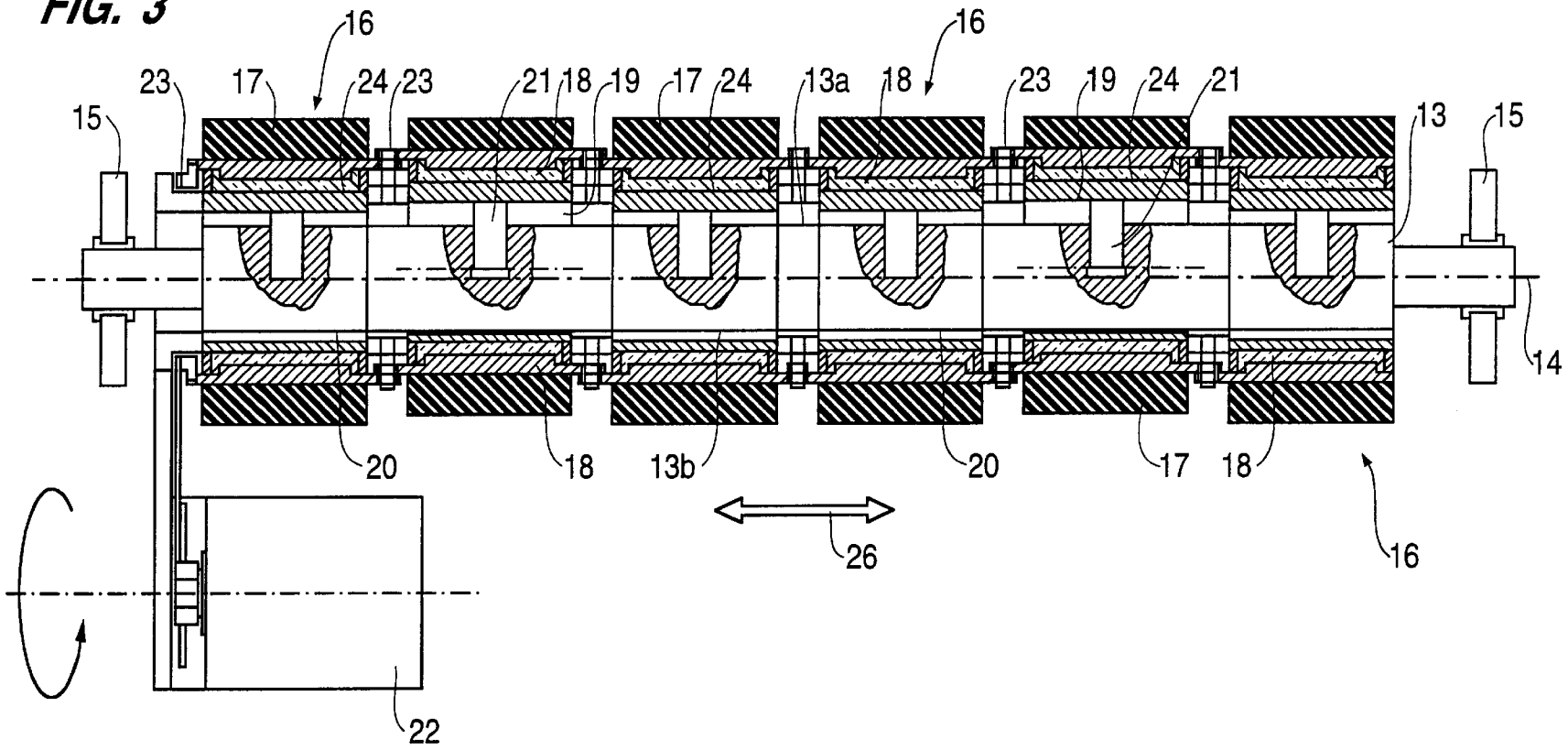
FIG. 3 shows a longitudinal section of the device shown in FIG. 2.

In the following description, the in-line grinding device 10 according to the invention is shown applied to the working rolls 11 of a four high rolling stand which has the relative support rolls 12; however it must be remembered that this description includes at least the applications to the support rolls 12 and the pinch rolls arranged in cooperation with the winding reels in a plane rolling line.

The device 10 according to the invention comprises a support beam 13 arranged with its longitudinal axis 14 substantially parallel to the longitudinal axis of the roll 11 to be ground.

This support beam 13 has an upper plane face 13*a* and a lower plane face 13*b*, parallel to each other and arranged in a parallel direction with respect to the longitudinal axis of the roll 11.

The support beam 13 is supported at the ends by side supports 15, in this case prismatic, and it can translate axially with respect to these side supports 15 in the direction 26 driven by the appropriate drive device, not shown here.

This drive device is suitable to generate an alternate translation movement so as to distribute the grinding action over all the circumferential surface of the roll 11.

The side supports 15 are mounted on a suitable structure for generating a to-and-fro movement, in the direction 27, with respect to the roll 11.

The main purpose of this to-and-fro movement is to position the device 10 according to the field of variation of the diameters of the rolls 11 being worked and the diameter of the grinding wheels.

A further purpose is to free the area during the steps when the rolls 11 are changed.

This structure (not shown here) can for example be a part of the equipment to guide the rolled product which is normally present at the entrance to the stand, or it can be an autonomous assembly.

On the support beam 13 there is a plurality of grinding units 16, arranged at intervals, axially fixed at least during the working step and having a relative grinding tool 17 mounted on a relative support ring 18.

The number, the reciprocal distance and the width of the grinding tool 17 of these grinding units 16 are such as to allow, together with the axial translation movement of the entire device 10, an effective action over the whole lengthwise extension of the roll 11.

Between every support ring 18 and support beam 13 there is a feeding block composed of a body 19 with a substantially cylindrical outer surface 19*a* coupling with the relative support ring 18, and plane inner surfaces, respectively the upper plane surface 19*b* and the lower plane surface 19*c*, having a sliding fit with the respective plane surfaces 13*a* and 13*b* of the support beam 13.

Between every feeding block and the support beam 13, in correspondence with the connecting sides of the plane surfaces 13*a*, 19*b* and 13*b*,19*c*, in reciprocal contact, there is a free space 20 which makes it possible for the grinding unit 16 to be moved radially with respect to the support beam 13.

Between the body 19 and the relative support ring 18 there is an annular bearing or bushing 24.

Each grinding unit 16 moreover has its own thrust device 21, arranged in the appropriate seatings inside the support beam 13.

The thrust device 21 can be composed, for example, of springs with a differentiated pre-stress, by packs of springs, by autonomously and independently driven pneumatic or hydraulic rolls, or other similar devices.

These thrust devices 21 are suitable to generate a controlled displacement movement of the relative grinding tool 17 in a direction radial to the longitudinal axis of the roll 11, bringing the grinding unit 16 nearer to or farther from the surface of the roll 11 according to necessity.

Advantageously, the thrust device drive 21 is governed by a data processing and control unit which receives signals from reading means to read the surface profile of the roll 11 and from position transducer means associated with the grinding tools 17.

The position transducers can be of the sensor type 25 installed in cooperation with the thrust device 21, or of any other type suitable to perform this function.

The means to read the surface profile can be of any known type normally used in off-line grinding procedures.

According to this configuration each grinding unit 16 can be associated with the surface of the roll 11 in relation to the real conditions of deterioration of the specific surface section, therefore taking into account any possible differentiated depressions which may be found there.

The action of the grinding units 16 can be corrected in a substantially instantaneous manner, by conforming the whole device 10 to the conditions which are found as the cycle gradually proceeds.

Moreover this makes the action of the grinding units 16 substantially unaffected by the differentiated wear of the various grinding tools 17, with relation to a greater or lesser removal of material from the surface of the roll 11, by adjusting in a differentiated and independent manner the radial position of the grinding unit 16 itself.

The rotary movement of the grinding units 16 is controlled, in this case at one end of the support beam 13, by a motorised transmission and drive unit 22 connected to the first grinding unit 16 by means of a joint system 23.

This movement is then transferred along the whole extension of the support beam 13 through joint means 23 which connect two adjacent grinding units 16.

The function of these joint systems 23 is to guarantee the transmission of the movement to the support rings 18 of the grinding tools 17 even when the support rings 18 have their relative axes parallel but not aligned.

Thus the grinding units 16 have absolute and independent freedom of radial movement and the ability to transmit the rotary movement is unchanged.

The joint systems 23 can be of any type suitable to perform this function, such as for example the Oldham homokinetic joint or the Schmidt homokinetic joint.

We claim:

1. In-line grinding device for rolls of a rolling plant, comprising: a common support beam having a longitudinal axis substantially parallel to a longitudinal axis of the roll to be ground, and a plurality of grinding units, each having a rotatable grinding tool, the grinding tools covering in their entirety a substantial part of the length of the roll to be ground, each of the grinding units being mounted on the common support beam such that an axis of rotation of each grinding unit can be moved independently from the other grinding units, in a substantially radial direction with respect to the longitudinal axis of the roll to be ground.

2. Device as in claim 1, in which each grinding unit comprises at least a relative thrust device arranged inside the common support beam and acting inside the relative grinding tool in a substantially radial direction with respect to the axis of the roll to be ground.

3. Device as in claim 2, in which the thrust device comprises springs with adjustable pre-stressing.

4. Device as in claim 2, in which the thrust device comprises a pneumatic actuator.

5. Device as in claim 2, in which the thrust device comprises a hydraulic actuator.

6. Device as in claim 1, which comprises a data processing and controlling unit which controls the independent movement of each grinding unit according to signals at least relative to at least one of a surface profile of the roll to be ground and an actual position of the grinding tool with respect to the surface of the roll.

7. Device as in claim 1, in which each grinding unit comprises a first support axially fixed to the common support beam and having inner surfaces with a reciprocal sliding fit, in a radial direction with respect to the axis of the roll to be ground, with mating surfaces of the common support beam, there being defined a free space of movement between respective connecting sides of the sliding fit surfaces, and a second support on which the grinding tool is mounted rotatably supported on the first support.

8. Device as in claim 1, in which every grinding unit is operably connected to a common drive unit by means of a joint system to transmit rotation to each grinding tool.

9. Device as in claim 8, in which the joint system is a Schmidt homokinetic joint.

10. Device as in claim 1, in which the common support beam can be moved axially.

11. Device as in claim 1, in which the common support beam can be moved radially with respect to the surface of the roll to be ground.

* * * * *

UNITED STATES PATENT AND TRADEMARK OFFICE

CERTIFICATE OF CORRECTION

PATENT NO. : 5,997,389
DATED : December 7, 1999
INVENTOR(S) : Giacinto Dal Pan et al.

It is certified that error appears in the above-identified patent and that said Letters Patent is hereby corrected as shown below:

Title page,
Item [73], Assignee, replace "Danieli & C. Officine Meccanich SpA" with
-- Danieli & C. Officine Meccaniche SpA --.

Signed and Sealed this

Twelfth Day of November, 2002

*Attest:*

*Attesting Officer*

JAMES E. ROGAN
*Director of the United States Patent and Trademark Office*